United States Patent [19]

Weisgerber et al.

[11] Patent Number: 4,784,060

[45] Date of Patent: Nov. 15, 1988

[54] METHOD AND APPARATUS FOR VARYING INK FLOW IN A PRINTING MACHINE INKING MECHANISM BY DIFFERENTIAL ADJUSTMENT OF AN INK METERING DEVICE AT INDIVIDUAL LOCATIONS ALONG ITS LENGTH

[75] Inventors: Willi Weisgerber, Johannisberg; Manfred Aroldi, Mainz/Rhein, both of Fed. Rep. of Germany

[73] Assignee: Miller-Johannisberg Druckmaschinen GmbH, Weisbaden, Fed. Rep. of Germany

[21] Appl. No.: 469,767

[22] Filed: Feb. 25, 1983

Related U.S. Application Data

[63] Continuation of Ser. No. 284,375, Jul. 17, 1981, abandoned.

[30] Foreign Application Priority Data

Jul. 24, 1980 [DE] Fed. Rep. of Germany ..... 3028025

[51] Int. Cl.[4] ..... B41F 31/04

[52] U.S. Cl. ..... 101/426; 101/365; 101/DIG. 24; 101/DIG. 26

[58] Field of Search ..... 101/426, 365, 350, 349, 101/206, 207, 208–210, DIG. 24, DIG. 26

[56] References Cited

U.S. PATENT DOCUMENTS 3,930,447 1/1976 Murray ..... 101/365
3,970,393 7/1976 Krygeris et al. ..... 356/195

FOREIGN PATENT DOCUMENTS 2000082 1/1979 United Kingdom .
2024457 1/1980 United Kingdom ..... 101/365

*Primary Examiner*—J. Reed Fisher
*Attorney, Agent, or Firm*—Robert B. Frailey

[57] ABSTRACT

A method and apparatus for varying the flow of ink by differential adjustment at individual adjustment locations along the length of an ink metering device of a printing machine inking mechanism by a plurality of adjusting devices such as control motors, stepping mechanisms or the like, which are adjustable to differing extents by electronic control devices in accordance with variations in reference value presettings which are the same for all individually adjustable adjustment locations, using reference value-real value comparators which cause actuation of the adjusting devices, in which a reference value memory is provided for each adjusting device, and upon input of reference value variations the values of all reference value memories are multiplied by a selected predetermined reference value variation factor and the products of the multiplication are transmitted as new reference values to the reference value-real value comparator.

6 Claims, 3 Drawing Sheets

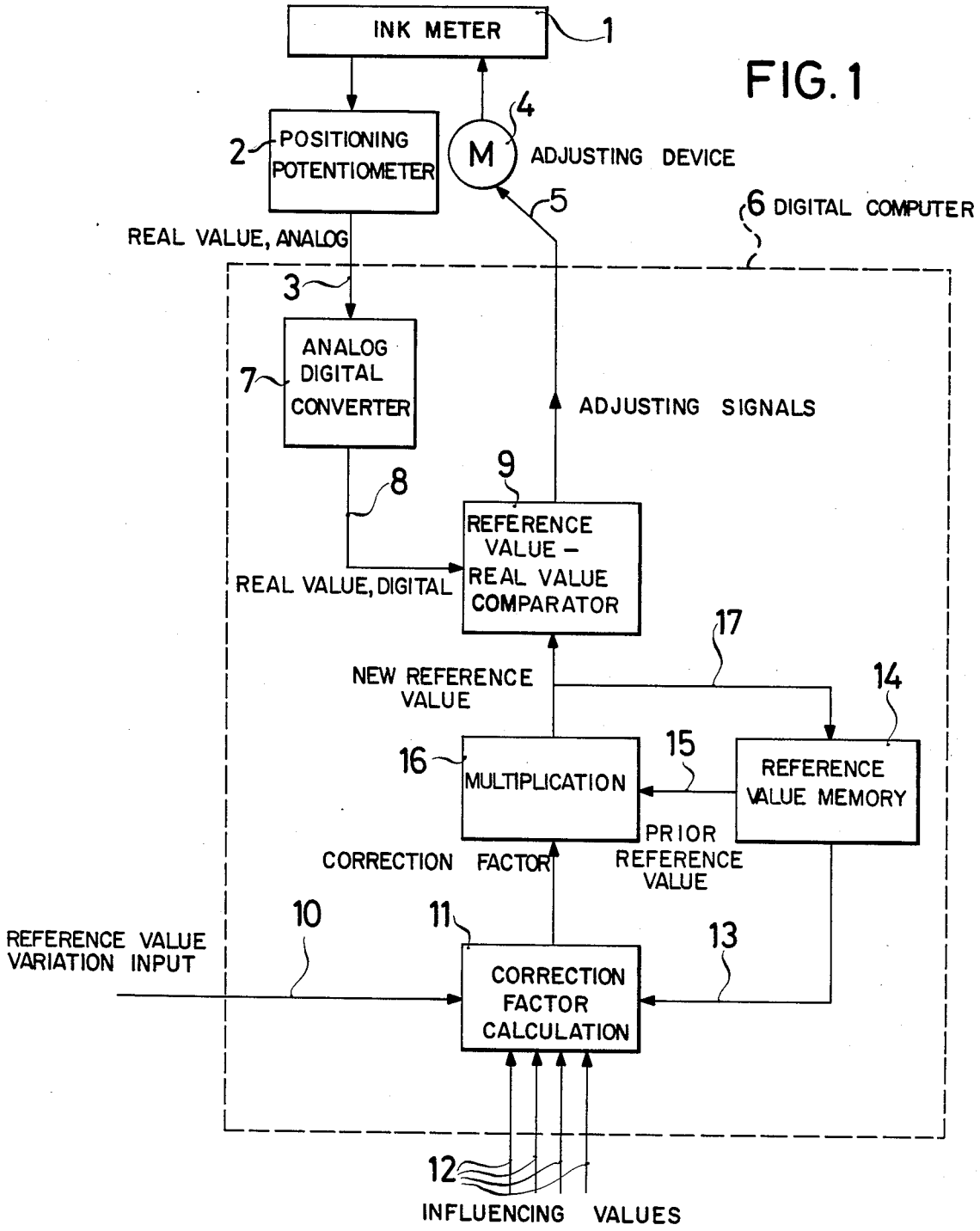
INK METER
1
FIG. 1
4
2
POSITIONING POTENTIOMETER
M
ADJUSTING DEVICE
5
6 DIGITAL COMPUTER
REAL VALUE, ANALOG
3
ANALOG DIGITAL CONVERTER
7
ADJUSTING SIGNALS
9
8
REFERENCE VALUE – REAL VALUE COMPARATOR
REAL VALUE, DIGITAL
17
NEW REFERENCE VALUE
14
15
16
MULTIPLICATION
REFERENCE VALUE MEMORY
PRIOR REFERENCE VALUE
CORRECTION FACTOR
10
11
13
REFERENCE VALUE VARIATION INPUT
CORRECTION FACTOR CALCULATION
12
INFLUENCING VALUES

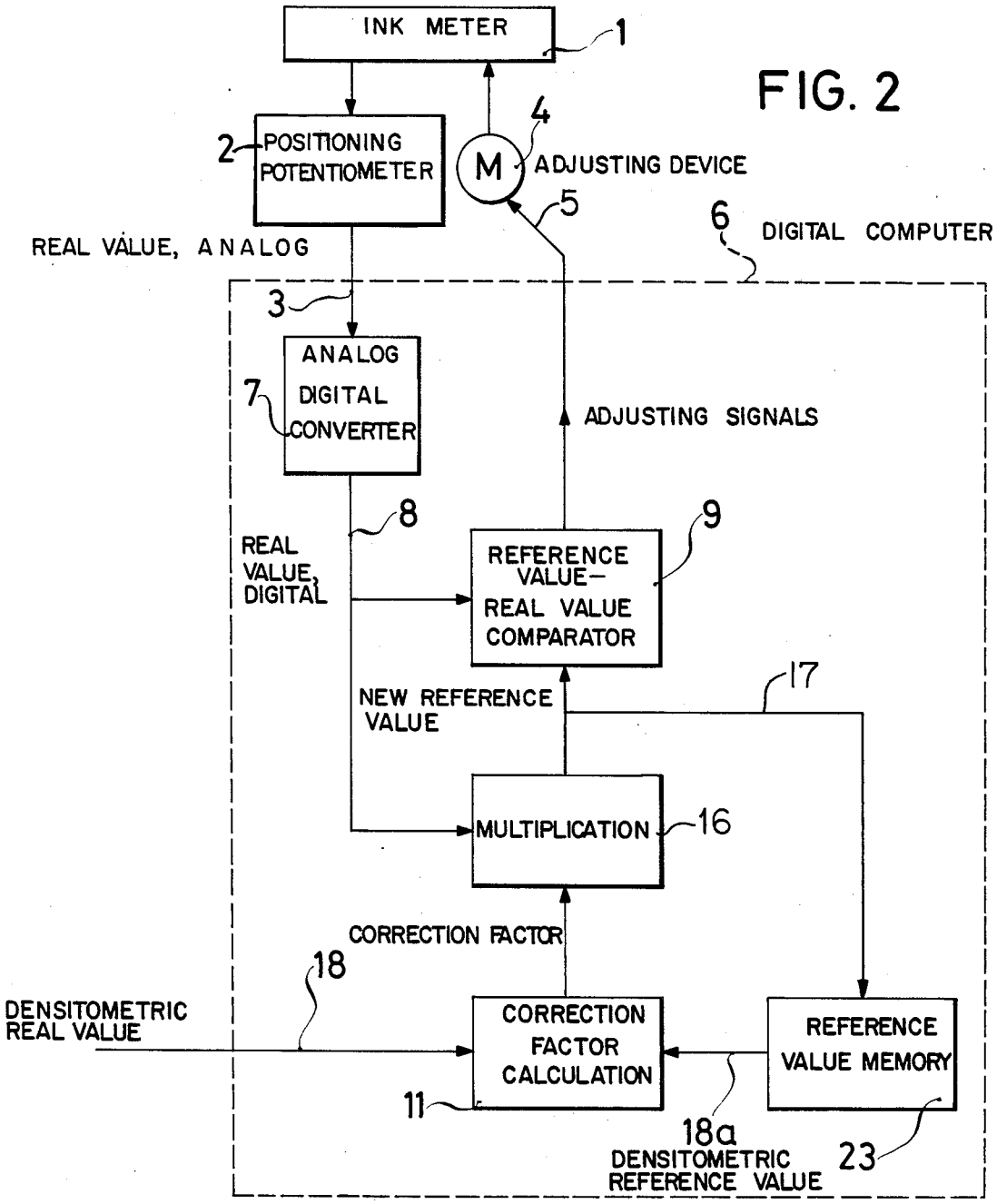
INK METER
1
FIG. 2
2
POSITIONING POTENTIOMETER
M
4
ADJUSTING DEVICE
5
6
DIGITAL COMPUTER
REAL VALUE, ANALOG
3
ANALOG DIGITAL CONVERTER
7
ADJUSTING SIGNALS
8
9
REAL VALUE, DIGITAL
REFERENCE VALUE-REAL VALUE COMPARATOR
17
NEW REFERENCE VALUE
MULTIPLICATION
16
CORRECTION FACTOR
18
DENSITOMETRIC REAL VALUE
CORRECTION FACTOR CALCULATION
REFERENCE VALUE MEMORY
11
18a
DENSITOMETRIC REFERENCE VALUE
23

METHOD AND APPARATUS FOR VARYING INK FLOW IN A PRINTING MACHINE INKING MECHANISM BY DIFFERENTIAL ADJUSTMENT OF AN INK METERING DEVICE AT INDIVIDUAL LOCATIONS ALONG ITS LENGTH

This application is a continuation of application Ser. No. 284,375, filed 7/17/81, now abandoned.

This invention relates to a method of varying the flow of ink by differential adjustment at individual locations along the length of an ink metering blade, or of individual ink metering elements which in combination correspond to a continuous ink metering blade, in a printing machine inking mechanism, and to apparatus for carrying out such a method.

In known inking mechanisms, adjustment of the ink metering device at individual lengthwise spaced locations across the width of the mechanism, which device determines the amount of printing ink which is applied by an ink reservoir or fountain to a ductor or ink fountain roller, is effected by adjusting means such as control motors, stepping mechanisms or the like which are remotely controlled. Conventionally, such ink metering device may be a continuous inking blade or a series of individual ink metering elements which, in combination, correspond to an ink metering blade.

This invention constitutes an improvement to the ink metering adjustment apparatus disclosed in German Pat. No. 2,714,577, which apparatus also is disclosed in British Pat. No. 1,587,026 and U.S. Pat. No. 4,193,345, the latter two patents being counterparts of, and claim the priority of, German Pat. No. 2,714,577 aforesaid.

The apparatus of this kind, disclosed in German Pat. No. 2,714,577 and its corresponding British and U.S. patents aforesaid, seeks to ensure that, upon common adjustment of the ink metering elements over the entire width of the inking mechanism, with all the ink metering elements being disposed at a selected distance from the ductor roller, the film of ink in the locations where the ink metering elements are close to the ductor roller, that is to say, where the gap between the ink metering elements and the ductor is small, is not altered excessively on a percentage basis in comparison with the locations where the ink metering elements are further away from the ductor, that is to say, where the gap between the ink metering elements and the ductor is larger, and vice-versa. In order to ensure that the size of the gap between the ink fountain roller or ductor and the ink metering element, for determining the flow of ink, is altered with a preselectible percentage of its instantaneous value, the German patent apparatus provides that an electrical memory is connected downstream of each ink metering element movement detector (which can be for example a potentionmeter). The electrical memory stores the reference voltage values which are associated with the individual positions of the respective ink metering elements. Circuit breaker means are arranged between the movement detectors and the memories. The apparatus also has comparisons for comparing an output signal from the memories to the output signal of the movement detectors and for actuating the ink metering element adjusting devices when the above-mentioned output signals deviate from each other. For the purposes of adjusting the reference value (selected reference value corrections), the apparatus has a means for altering the supply voltage of the movement detectors. A timing means is necessarily provided for re-connecting the memories into circuit. A comparator having a fixed reference voltage also is necessarily provided for resetting the supply voltage of the movement detectors to the output voltage.

In that apparatus, when making a transition to a new reference value, the starting point is the previous actual value position, which can deviate to a greater or lesser extent from the previous reference position as a result of inevitable inaccuracies and equally inevitable limits in regard to the degree of fineness of adjustment of the desired reference value. However, this deviation also can be carried over when the reference value is altered because the starting point used is not the preceding reference value, but the previous actual value produced on the basis of that reference value which can, under some circumstances, differ therefrom for the above-specified reasons.

The problem of the present invention is to provide a method and apparatus which are simplified in comprison with previously known methods and apparatuses, and which operate more accurately in regard to varying the ink flow adjustments at individual lengthwise spaced locations of the inking mechanism.

Accordingly, the present invention provides a method of varying the flow of ink by differential adjustment at individual adjustment locations along the length of an ink metering blade, or of individual ink metering elements which in combination correspond to a continuous ink metering blade, in a printing machine inking mechanism, by means of a plurality of adjusting devices each of which is adjustable selectively by means of electrical or electronic control devices in accordance with selected reference value corrections, which are the same for all individually adjustable adjusting locations along the length of the ink blade, or for all individually adjustable ink metering elements, using reference value-real value comparison means which cause actuation of the adjusting devices, in which:

(a) a reference value memory is provided for each adjusting device;

(b) upon input of variations in reference value presettings as determined by a reference value adjusting device, the values of all reference value memories are multiplied by a selected predetermined reference value correction factor; and (c) the product of said multiplication is transmitted as a new reference value to the reference value-real value comparison means.

The method and apparatus of this invention preferably is in the form of a digital system. It is simpler than the known analog system and suffers from fewer sources of error. This method does not start from the preceding actual values, i.e. real values, of the settings, but from previous reference values, that is to say, from theoretical values which are actually desired, but which may not be precisely attained under some circumstances. This is particularly apparent when settings in respect of the inking mechanism, which were determined for continuous printing and then were stored in some form, are to be reproduced.

The actual or real value detectors used in the method and apparatus of the invention for reference value-real value comparison affect only the setting operations of adjusting devices, such as control motors, which carry out selective adjustments at the spaced adjusting locations along the length of the ink metering blade, or which effect selective adjustments of individual ink metering elements, when such elements are used in lieu of an ink metering blade. The real value detectors do not effect the establishment of new reference values resulting from the input of reference value variations or corrections.

Now, it is known that the optimum setting of an inking mechanism in respect of selecting and maintaining the desired flow of ink in the transverse direction of the inking mechanism depends on a number of factors. These factors include the specific requirements of ink for the particular images to be printed, the temperature of the inking mechanism, the temperature of the printing plate, the consistency of the ink in the inking mechanism, the presence of moisture, the peripheral speed of the ductor and the pressure of the ink on the ink blade or the individual ink metering elements, which is related to the ductor peripheral speed, mechanical influences generated by the particular characteristics of the printing machine, and many others. Some of these influences can be established by computation, for example in the form of an equation or by tabular means, while others can be established empirically, for example in the form of a curve. However, heretofore it has not been possible for such knowledge, whether obtained theoretically or by practical means, to be properly applied to the settings of the ink metering device, such as an ink blade or ink metering elements, of a printing machine inking mechanism. The method of this invention can be used for such purposes. In a specific embodiment thereof, wherein a computer is utilized, the following steps are performed:

(a) variations in reference value presettings are inputted into a computer;

(b) influencing factors which affect the flow of the ink, such as ink temperature, ink consistency, presence of moisture, ductor deformation, the action of hydrostatic pressure of the ink on the ink metering device, etc., which are measured by sensors, are inputted into the computer; and (c) utilizing the foregoing inputs and the previously stored ink metering reference values, the computer calculates new reference values either with a preferably interchangeable digital program (established, for example, by equation or tabular means) or by an analog program (for example, established by a curve), and transmits such new reference values to the reference value-real value comparison means.

By the foregoing method, selected adjustment or setting of the ink metering devices—for example, individual adjustment at spaced locations along the length of an ink blade or separate adjustment of individual ink metering elements—can be effected in an optimum manner, in accordance with all available factors, automatically and in a manner capable of reproduction. Adjustment at the individual locations along the length of the ink blade, or of the individual ink metering elements, is not proportional merely to the previously set width of the gap between the ink blade and the ductor. Instead, such adjustment is effected individually in respect of each individually adjustable location of the ink blade or of each ink metering element, or in respect of individual groups thereof, in accordance with additional inter-relationships superimposed on the above-mentioned proportional mode of adjustment.

In the event new factors or influences appear in regard to the optimum setting of the ink blade, or of the individual ink metering elements, these can be taken into account in an extremely simple manner since programming of the programmer means or the computer can be suitably amended or supplemented.

According to another embodiment of the invention, the method also may be such that:

(a) resulting real values (for example by means of a densitometer, e.g. a device for measuring the thicknesses of the layers of ink) are inputted into the computer; and (b) the computer uses such input in conjunction with a previously stored ink density reference values and the ink metering element real values to determine the new ink metering element reference values, with a preferably interchangeable digital program (established for example by equation or tabular means), and to transmit said new values to the reference value-actual value comparison means.

It is known that the flow of ink from the inking mechanism also can be altered on a broad scale, that is to say, in regard to the basic setting which effects the entire width of the inking mechanism, by varying the speed of rotation of the ink fountain roller, or by varying the number of strokes and/or the stroke movement (i.e., ink strip width) when using a ductor which is driven in a stepwise manner. Such forms of influence on the control of the flow of ink can be incorporated into the method according to the invention and into the apparatus used for carrying out the method of the invention. Thus, in a further aspect of the invention, the computer which processes both the desired reference value adjustments and also other influencing parameters, instead thereof, or in addition thereto, may act on the ductor control means in respect of the speed of rotation in the case of a continuously driven ductor, or on the control means for controlling the number of strokes and/or the stroke movement when using a stepwise ductor drive, depending on the working speed of the machine but not proportionally thereto.

Apparatus for carrying out the method according to the invention may be of such a design that a computer is interposed between each actual value detector and each adjusting device. The computer compares data concerning the printing operation with the instructions of the programmer, and uses such comparison for an adjustment instruction to its respective adjustment device.

Preferred embodiments of the circuitry or apparatus used for carrying out the method according to the invention, which also show the steps of the method, are illustrated in highly diagrammatic form in the accompanying drawings in the form of block circuit diagrams, in which:

FIG. 1 shows a block circuit diagram for a preferred apparatus for carrying out the method according to the invention.

FIG. 2 shows a block circuit diagram for a modified apparatus for carrying out the method according to the invention in conjunction with densitometers.

The same element or elements which perform the same functions are denoted in all the Figures of the accompanying drawings by the same reference numerals.

Figure 3:
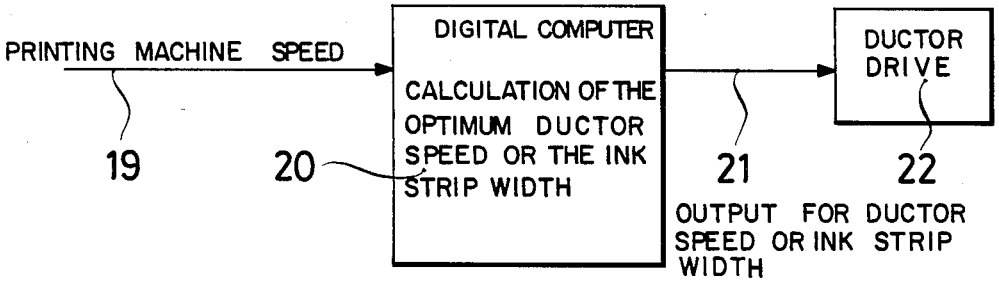
FIG. 3 shows part of an apparatus for controlling the ductor drive in carrying out the method of the invention.

An adjusting location along the length of an ink metering blade, or an individual ink metering element disposed across an inking mechanism, is denoted by reference numeral 1. The position of the ink blade, or of the ink metering element, at the adjusting location is transmitted by a position potentiometer 2 in the form of an analog real value by way of line 3. The element 1 is adjusted by means of an adjusting device 4 which may be, for example, a control motor, a stepping mechanism or another means suitable for that purpose. The real values produced by the potentiometer 2 and transmitted by the line 3 pass to, and the control signals supplied to the adjusting device 4 by way of line 5 come from, a digital computer which is indicated generally by reference numeral 6 and which is defined by the broken boundary line.

The digital computer 6 includes a conventional analog-to-digital converter 7 which converts the actual or real values produced by the potentiometer 2 into digital values which then are supplied via line 8 to a conventional reference value-real value comparator 9. Variations in reference value presettings, as determined by a conventional reference value adjusting device (not shown), are inputted into the digital computer 6 by the input line 10. The selected reference value corrections or variations determine the correction factor 11. Account also is taken of influencing parameters or values such as ink temperature and the like, which are supplied by way of lines designated generally by reference numeral 12, as well as the content of a reference value memory 14, supplied by line 15. The prior reference value stored in memory 14 is multiplied by the correction factor in multiplier 16 and passes via line 17 to be stored as a new reference value in the memory 14. The new reference value also passes via line 17 into the reference value-actual value comparator 9 which then transmits its adjusting or control signal by way of the line 5 to the adjusting device 4.

With reference now to FIG. 2, only those features in respect of which the FIG. 2 circuit differs from the circuit shown in FIG. 1 will be described. As previously mentioned, identical or equivalent components in FIG. 2 are denoted by the same terms and the same reference numerals as in FIG. 1. In this arrangement, the computer 6 which determines the correction factor is not supplied by way of the input line 10 with reference value variations as in the circuit of FIG. 1. Rather, the computer 6 is supplied with densitometric real values, as determined by a densitometer (not shown), by way of input line 18. The densitometric real value inputted by line 18 and the densitometric reference value transmitted via line **18*a* from reference value memory 23 are used in determining the correction factor. The reference value-real value comparator 9 compares the digital real value 8 to the new reference value which, in this case, is formed by multiplication in multiplier 16 of the actual value from line 8 by the correction factor aforesaid. Comparator 9 transmits its adjusting or control signal, by way of the line 5, to the adjusting device 4. In this arrangement, the denstiometric real values and densitometric reference values virtually replace the reference value variation input line 10 and the inputs of lines 12 carrying the influencing parameters of the circuit of FIG. 1**.

In the control system for the ductor drive shown in FIG. 3, a digital signal indicating the selected working speed of the printing machine is applied by way of a line 19 to a digital computer 20 which determines the optimum ductor speed, or the ink strip width of the ductor, at the selected printing machine working speed, which is inputted to the computer 20 by any kind of program. The computer 20 then passes the correct setting in respect of the ductor speed or the ink strip width to the ductor drive 22 by way of the line 21. The ductor drive control arrangement of FIG. 3 obviously can be used in conjunction with the control modes illustrated in FIGS. 1 and 2. In either such case, the computer 20 shown in FIG. 3 is combined with the computer 6 provided in the FIG. 1 circuit or the FIG. 2 circuit, so that the computer 6 also receives the machine speed information as a further input and supplies the pulses to the ductor drive 22 as a further output parameter.

The details of the structure or specific design of the various hardware elements utilized in the circuitry disclosed in the drawing are not part of the invention. In many cases, the hardware components are available as catalog items. In all cases, the structures, specific designs and functions of the hardware components used in the invention are matters of common and general knowledge in the art, and their selection and utilization will be obvious to one skilled in the art. For example, the position potentiometer 2, comparator 9 and memories 14, 23 may be of the kind disclosed in U.S. Pat. No. 4,193,345 aforesaid. The multiplier 16 may be of the type disclosed in U.S. Pat. No. 4,007,607. The inputting of corrections or variations to the preset reference values is equivalent to the inputting of variations in reference values into the apparatus of U.S. Pat. No. 4,193,345. Like that patent, in the practice of this invention the reference and real values preferably are in the form of electrical voltages.

I claim:

1. A method of varying the flow of ink in a printing machine inking mechanism by differential adjustment at individual adjustment locations spaced along the length of an ink fountain roller metering device, such as an ink blade or plural individual ink metering elements, by a plurality of adjusting devices, such as servo motors, stepping mechanisms or the like, each of which is adjustable selectively by a computer in accordance with variations in reference value presettings using reference value-real value comparison means to actuate the adjusting devices, including the following steps:

(a) providing for each adjusting device a reference value memory for storage of a selected reference value;

(b) storing a reference value presetting in the memories for the adjusting devices;

(c) inputting into the computer a correction to the reference value presetting and calculating a correction factor for the adjusting devices;

(d) multiplying the reference value presetting stored in the memories by the correction factor to obtain a new reference value; and (e) transmitting the new reference value to the reference value-real value comparison means to actuate the adjusting devices.

2. A method according to claim 1, further including the following steps:

(a) inputting into the computer influencing values such as variations in ink temperature, ink consistency, humidity level, density and the like and (b) using said inputted influencing values to calculate the new reference value for transmission to the reference value-real value comparison means.

3. A method according to claim 1, further including the following steps:

(a) wherein said step of storing includes storing a densitometric reference value in the memories for the adjusting devices;

(b) wherein said step of inputting includes inputting into the computer densitometric real values;

(c) using said inputted densitometric real values, the previously stored densitometric reference value and ink metering device real values, calculating a new densitometric reference value; and (d) wherein said step of transmitting includes transmitting the new densitometric reference value to the reference value-real value comparison means.

4. A method according to either of claims 1, 2 or 3, characterized in that the computer acts on ink fountain roller control means controlling the speed of rotation of a continuously driven roller to establish optimum speed of rotation of the roller in relation to the working speed of the printing machine, but not proportionally thereto.

5. A method according to either of claims 1, 2 or 3, characterized in that the computer acts on ink fountain roller control means controlling the number of strokes for a stepwise roller drive to establish optimum ink strip widths in relation to the working speed of the printing machine, but not proportionally thereto.

6. A method according to either of claims 1, 2 or 3, characterized in that the computer acts on ink fountain roller control means controlling the stroke movement for a stepwise roller drive to establish optimum ink strip widths in relation to the working speed of the printing machine, but not proportionally thereto.

* * * * *

UNITED STATES PATENT AND TRADEMARK OFFICE

CERTIFICATE OF CORRECTION

PATENT NO. : 4,784,060

DATED : November 15, 1988

INVENTOR(S) : Willi Weisgerber and Manfred Aroldi

It is certified that error appears in the above-identified patent and that said Letters Patent is hereby corrected as shown below:

Column 1, line 60 change "comparisons" to --comparators--

Column 5, line 56 change "denstiometric" to --densitometric--

Column 5, line 58 after "input" insert --via--.

Signed and Sealed this

Twenty-eighth Day of November 1989

*Attest:*

JEFFREY M. SAMUELS

*Attesting Officer* *Acting Commissioner of Patents and Trademarks*